US009790689B2

(12) United States Patent
Milanowski

(10) Patent No.: US 9,790,689 B2
(45) Date of Patent: Oct. 17, 2017

(54) BALUSTER CONNECTOR

(71) Applicant: Universal Consumer Products, Inc., Grand Rapids, MI (US)

(72) Inventor: Daniel Milanowski, Grand Rapids, MI (US)

(73) Assignee: Universal Consumer Products, Inc., Grand Rapids, MI (US)

( * ) Notice: Subject to any disclaimer, the term of this patent is extended or adjusted under 35 U.S.C. 154(b) by 0 days.

(21) Appl. No.: 14/514,775

(22) Filed: Oct. 15, 2014

(65) Prior Publication Data

US 2015/0102277 A1 Apr. 16, 2015

Related U.S. Application Data

(60) Provisional application No. 61/891,753, filed on Oct. 16, 2013.

(51) Int. Cl.
*E04H 17/14* (2006.01)
*E04F 11/18* (2006.01)

(52) U.S. Cl.
CPC ... *E04F 11/1842* (2013.01); *E04F 2011/1823* (2013.01); *E04F 2011/1827* (2013.01)

(58) Field of Classification Search
CPC ..... Y10T 403/32106; Y10T 403/32254; Y10T 403/32262; Y10T 403/32278; Y10T 403/32286; Y10T 403/32418; Y10T 403/32434; Y10T 403/32549; Y10T 403/32557; Y10T 403/32591; E04F 11/1842; E04F 11/1817; E04F 11/1812; E04F 11/1834
See application file for complete search history.

(56) References Cited

U.S. PATENT DOCUMENTS 2,255,262 A * 9/1941 MacFadden ..... F21V 21/30 285/185
4,436,690 A * 3/1984 Davis ..... B29C 33/76 264/313
5,437,433 A * 8/1995 Rezek ..... 256/67
2002/0176736 A1* 11/2002 Tsou ..... A45B 17/00 403/103
2009/0200532 A1* 8/2009 Platt ..... 256/67

FOREIGN PATENT DOCUMENTS

DE 19525334 A1 * 7/1996 ..... E04F 11/1834

* cited by examiner

*Primary Examiner* — Matthieu F Setliff
(74) *Attorney, Agent, or Firm* — McGarry Bair PC

(57) ABSTRACT

A baluster connector having a base and retaining member can be used to mount a baluster to a rail installed on both a horizontal and a sloped surface. The base can rotate relative to the retaining member to a first position to mount the baluster to a horizontal rail and to a second position to mount the baluster to an angled rail.

21 Claims, 11 Drawing Sheets

BALUSTER CONNECTOR

CROSS-REFERENCE TO RELATED APPLICATIONS

This application claims the benefit of U.S. Provisional Patent Application No. 61/891,753, filed Oct. 16, 2013 which is incorporated herein by reference in its entirety.

BACKGROUND

The embodiments of the invention relate generally to the field of railings.

Railings may contain several members that can be transported as disparate pieces, such as in knock down form, and assembled at the final location of the railing. The railing may be assembled with various horizontal members including rails, hand rails, grab rails, guard rails, bottom rails, mid rails and inclined rails, as well as vertical elements such as balusters, pickets, posts and spindles. The vertical members of the railing may be directly connected to the horizontal members by a variety of fastening means, such as welding, adhesives, screws, nails or connectors. Railings may be assembled on essentially flat, horizontal surfaces, or on sloped surfaces, such as along a stairway.

BRIEF SUMMARY

The embodiments of the invention relate to a connector for a railing system having a plurality of balusters disposed between an upper rail and a lower rail for connecting a baluster to one of the upper and lower rails. The connector comprises a base having a periphery and a central opening therein extending between first and second surfaces that are positioned at an inclined angle with respect to one another and a retaining member having a mounting portion configured to mount an end of a baluster at one end and an interengaging member at an opposite end configured to be rotatably mounted to the base in juxtaposition with respect to the second surface of the base. In a horizontal position, the interengaging member and the base form an axial relationship corresponding to an angle for the upper and lower railings in a horizontal orientation, and in a second inclined position, the interengaging member and the base form an inclined relationship corresponding to an angle for the upper and lower railings on an inclined staircase. When the base is mounted to one of the upper or lower rails of the railing system and moved to one of the horizontal or inclined positions with respect to the retaining member, the mounting portion of the retaining member can be mounted to a baluster to mount the baluster with respect to the upper or lower rail.

DETAILED DESCRIPTION

Figure 2:
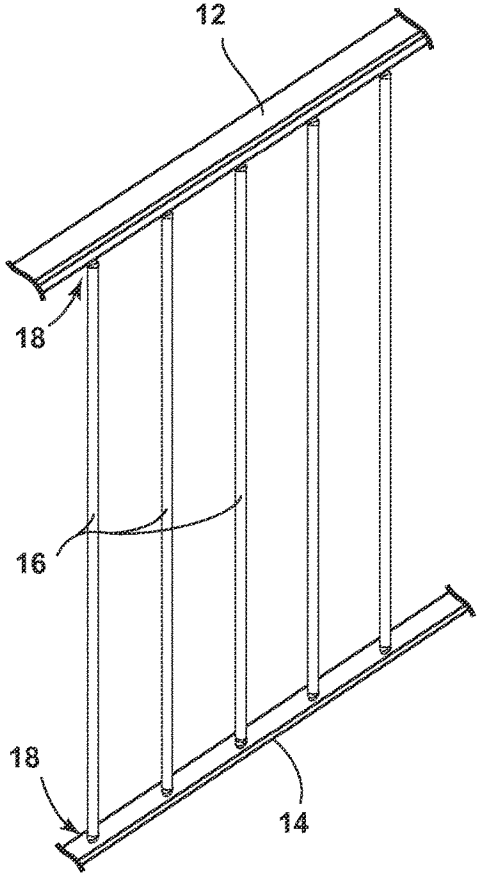
FIG. 2 is a schematic representation of a portion of a railing assembly according to an embodiment of the invention.
Figure 1:
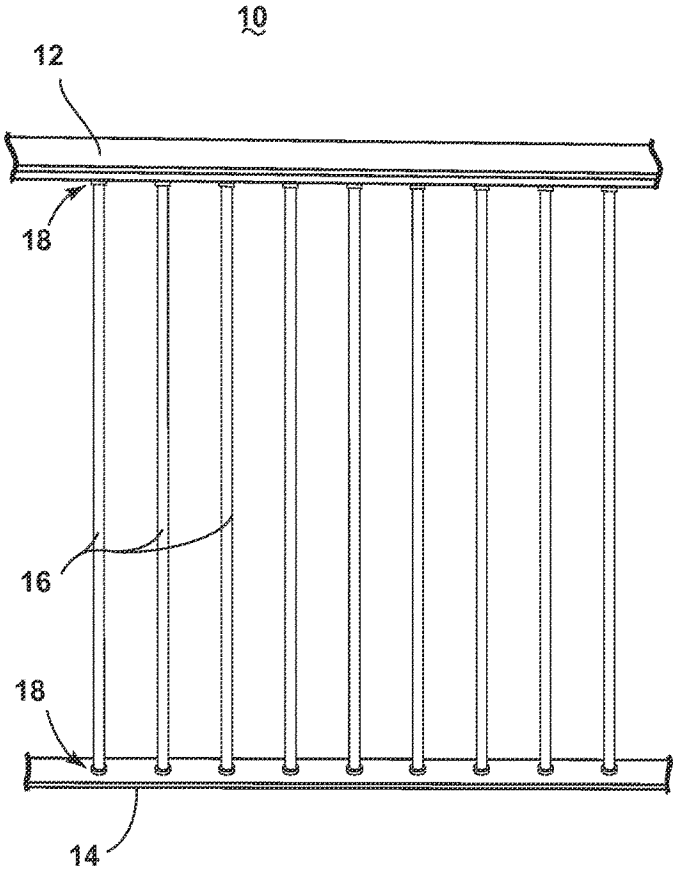
FIG. 1 is a schematic representation of a portion of a railing assembly according to an embodiment of the invention.

FIGS. 1 and 2 illustrate a railing assembly 10 installed on a flat, horizontal surface (FIG. 1) and a sloped surface (FIG. 2). As used herein, a railing assembly installed on a flat, horizontal surface, such as a deck floor, for example, is referred to as a horizontal railing assembly and a railing assembly installed on a sloped surface, such as a hill side or along a stairway, is referred to as an angled railing assembly.

Figure 1A:
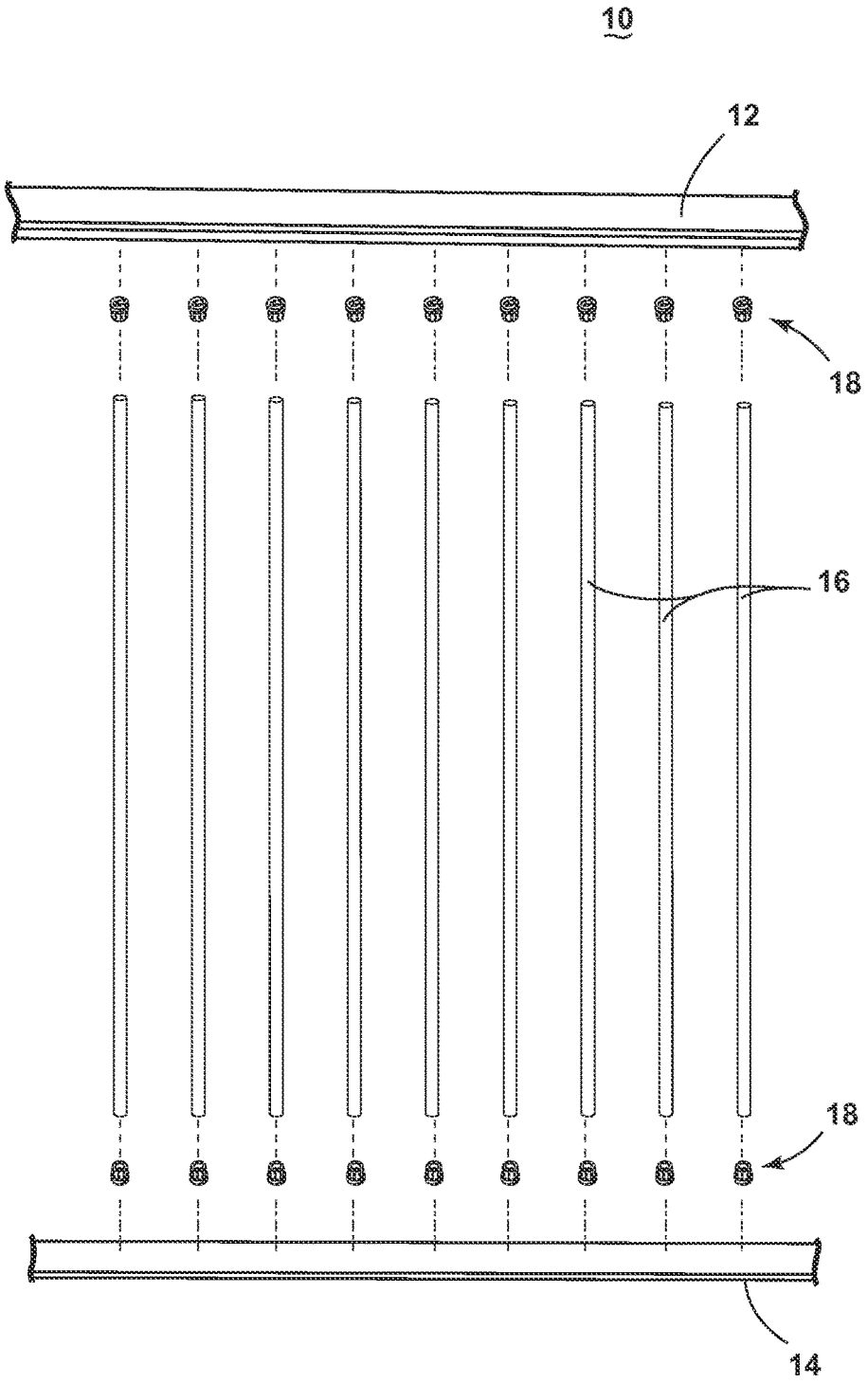
FIG. 1A is an exploded view of the railing assembly of FIG. 1 according to an embodiment of the invention.

Referring now to FIGS. 1, 1A, and 2, the railing assembly 10 includes an upper rail 12 and a lower rail 14 with a plurality of balusters 16 extending therebetween. Each baluster 16 can be connected with the upper and lower rails 12, 14 by a connector 18, which is described in more detail below. When the upper and lower rails 12, 14 are installed on a horizontal surface (FIG. 1), the upper and lower rails 12, 14 are referred to as horizontal rails; when the rails 12, 14 are assembled on a sloped surface (FIG. 2), the rails 12, 14 are referred to as angled rails.

The rails 12 and 14 can be constructed of any known material, including, but not limited to, metal and metal alloys, such as wrought iron, iron, copper, brass, aluminum, stainless steel, and galvanized steel, as well as, wood, wood composite or plastic. Similarly, the balusters 16 can be hollow and constructed of similar materials as the rails 12 and 14, although it is within the scope of the invention for the balusters 16 and rails 12 and 14 to be made from different materials. Each of these rails 12 and 14 and balusters 16 can be constructed using known forming processes, including but not limited to, extrusion, forging, molding, and cutting. The connector 18 can be made from any suitable metal, metal alloy, wood, wood composite or plastic, but is preferably made from plastic.

Figure 3:
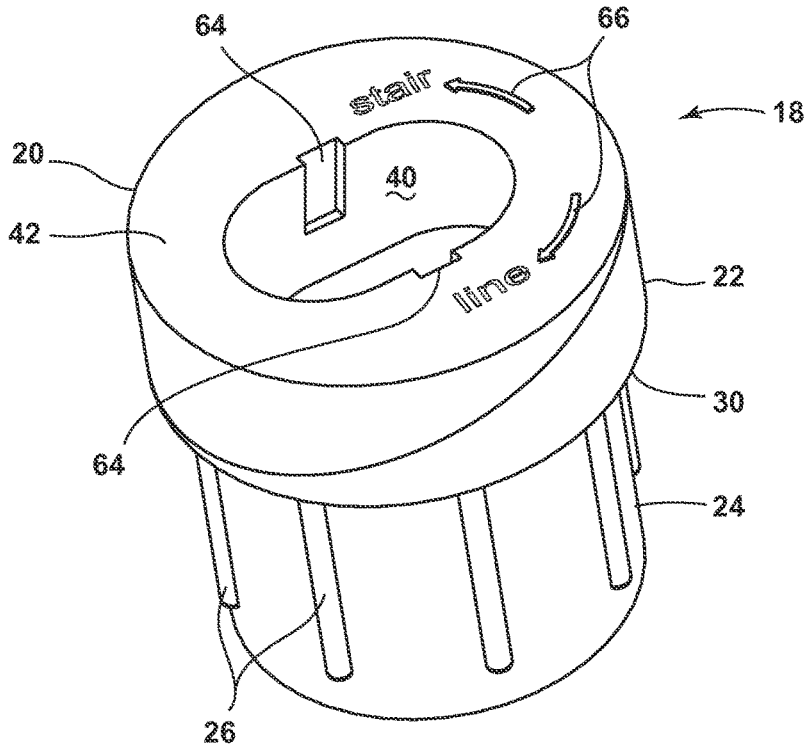
FIG. 3 is an isometric view of a connector for use with a railing assembly according to an embodiment of the invention.
Figure 4:
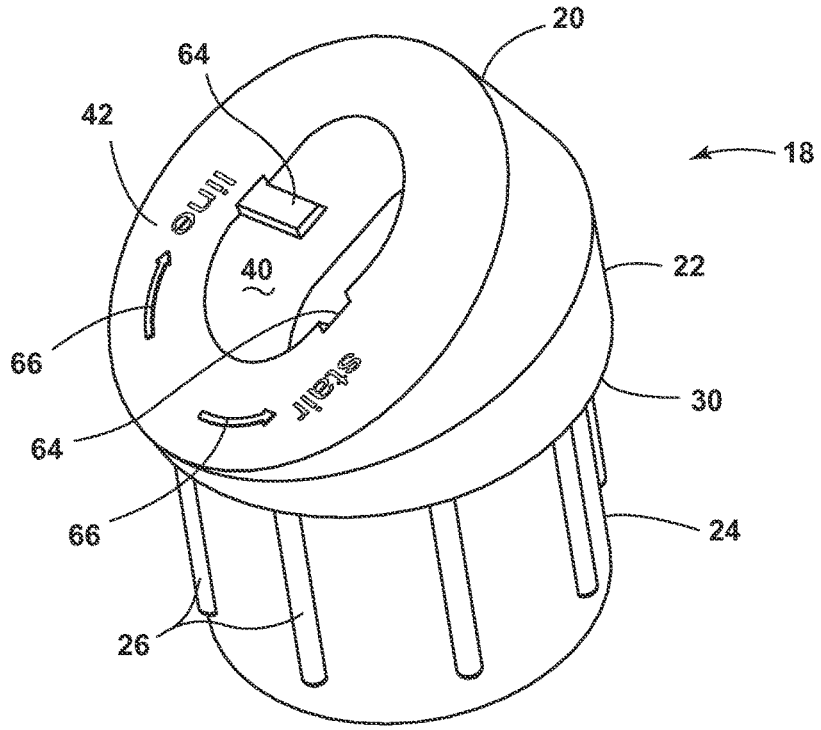
FIG. 4 is an isometric view of a connector for use with a railing assembly according to an embodiment of the invention.
Figure 5:
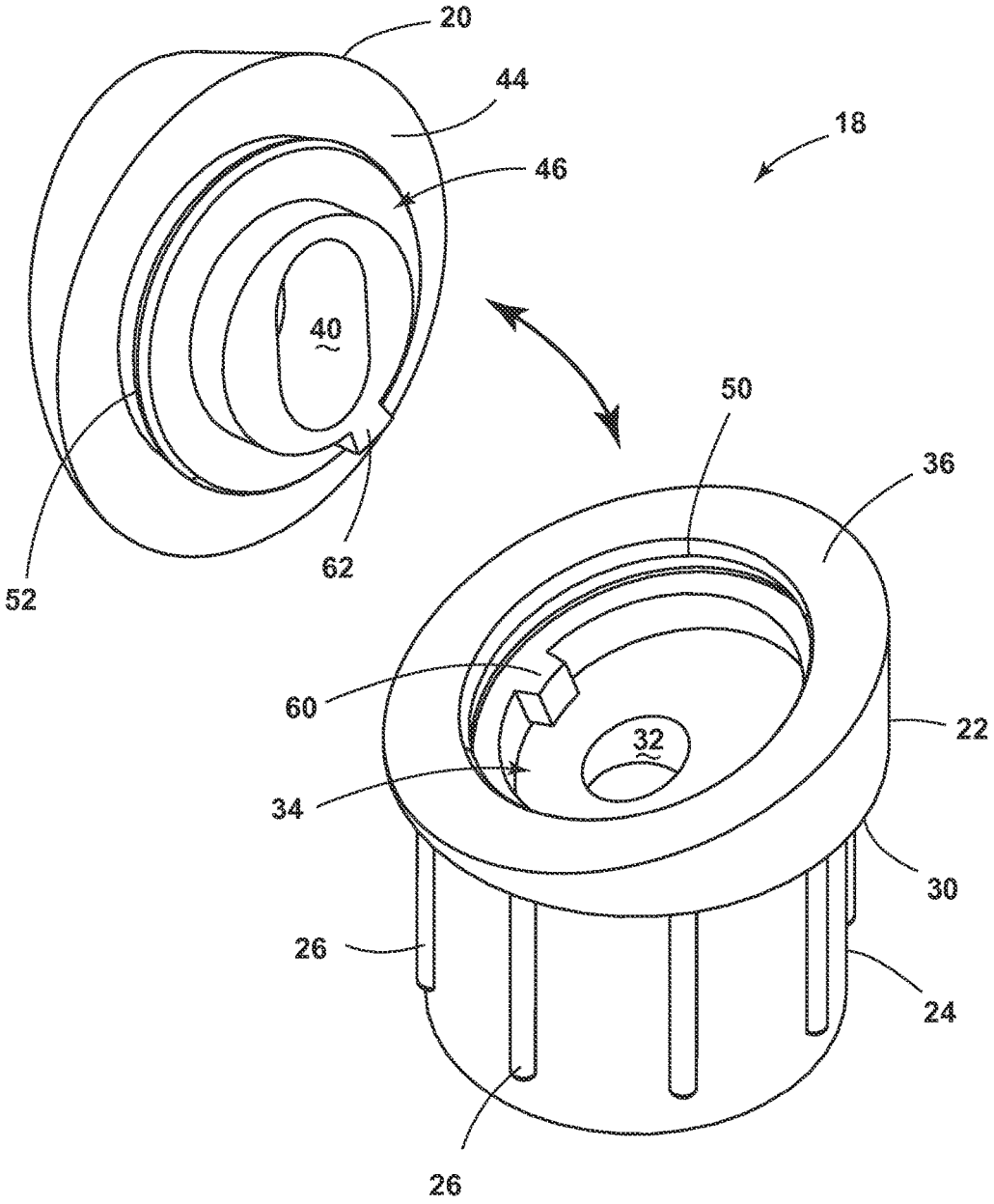
FIG. 5 is an exploded view of the connector of FIGS. 3 and 4 according to an embodiment of the invention.

Referring now to FIGS. 3-5, the connector 18 is a two piece-connector that includes a base 20 and a baluster retaining member 22. The base 20 is configured to be fastened to the upper or lower rail 12, 14 and the retaining member 22 is configured to mount a baluster 16. The retaining member 22 includes a mounting portion 24 which is configured to be received within the baluster 16, which is formed as a hollow cylinder (see FIG. 1A). The mounting portion 24 can be sized and shaped so as to frictionally retain the baluster 16 inserted thereon, and can optionally include rib protrusions 26 to facilitate retaining the baluster 16. The mounting portion 24 can extend from a baluster mounting face 30 of the retaining member 22. Alternatively, the baluster 16 can be slid onto the mounting portion 24 and held in place using any other suitable mechanical or non-mechanical fastener, such as a snap-fit, a resilient detent, a connector pin, or an adhesive, for example. In another example, the baluster 16 can simply fit loosely around the mounting portion 24. Alternatively, the baluster 16 and the mounting portion 24 can be sized and shape so that the mounting portion 24 receives the baluster 16 within a channel provided in the mounting portion 24. In this example, the baluster 16 would not need to be hollow and could be solid.

The mounting portion 24 can be hollow to provide a central fastener aperture 32 for receipt of a fastener, such as a screw (see FIGS. 8 and 9), for attaching the connector 18 to the adjacent rail 12, 14. The fastener aperture 32 may be provided with a tapered screw seat at an outer end thereof (see FIGS. 8 and 9). The retaining member 22 further includes a female interengaging member 34 and a mating surface 36 opposite the baluster mounting face 30. As illustrated the fastener aperture 32 of the retaining member 22 may be smaller than the fastener aperture 40 of the base 20

Still referring to FIGS. 3-5, the base 20 includes a central opening forming a fastener aperture 40 through which a fastener inserted into the retaining member 22 extends for mounting the connector 18 to the adjacent rail 12, 14. The base 20 includes a rail mounting surface 42 and a mating surface 44. The base 20 also includes a male interengaging member 46 configured to be received by the female interengaging member 34 of the retaining member 22. When assembled, the male interengaging member 46 of the base 20 is received by the female interengaging member 34 of the retaining member 22 such that the respective mating surfaces 36 and 44 of the retaining member 22 and base 20, respectively, are adjacent one another (see FIGS. 8 and 9). While the embodiments of the invention are described in the context of the base 20 including the male interengaging member 46 and the retaining member 22 including the female interengaging member 34, it is understood that the location of the male and female connecting portions 46, 34 can be switched between the base 20 and retaining member 22 without deviating from the scope of the invention.

The female interengaging member 34 of the retaining member 22 is configured to receive the male interengaging member 46 of the base 20 such that the base 20 can rotate relative to the retaining member 22. The female interengaging member 34 can receive the male interengaging member 46 through a threaded connection. For example, as illustrated in FIG. 5, the female interengaging member 34 can include one or more grooves 50 which receive corresponding threads 52 on the male interengaging member 46. The female interengaging member 34 can include a pair of stops 60, which, in combination with a corresponding stop 62 on the male interengaging member 46 can limit the rotation of the base 20 relative to the retaining member 22.

As can best be seen in FIGS. 3 and 4, the rail mounting surface 42 of the base 20 can also be provided with a pair of opposing grooves 64 which can be configured to receive the head of a screw driver to facilitate rotation of the base 20 relative to the retaining member 22. Alternatively, the base 20 can be rotated by hand by grasping one of the base 20 or retaining member 22 and twisting one of the base 20 or retaining member 22 relative to the other. The rail mounting surface 42 can also optionally be provided with indicia 66, such as arrows and/or text, as illustrated, or other graphics to provide use instructions to the user.

Figure 6:
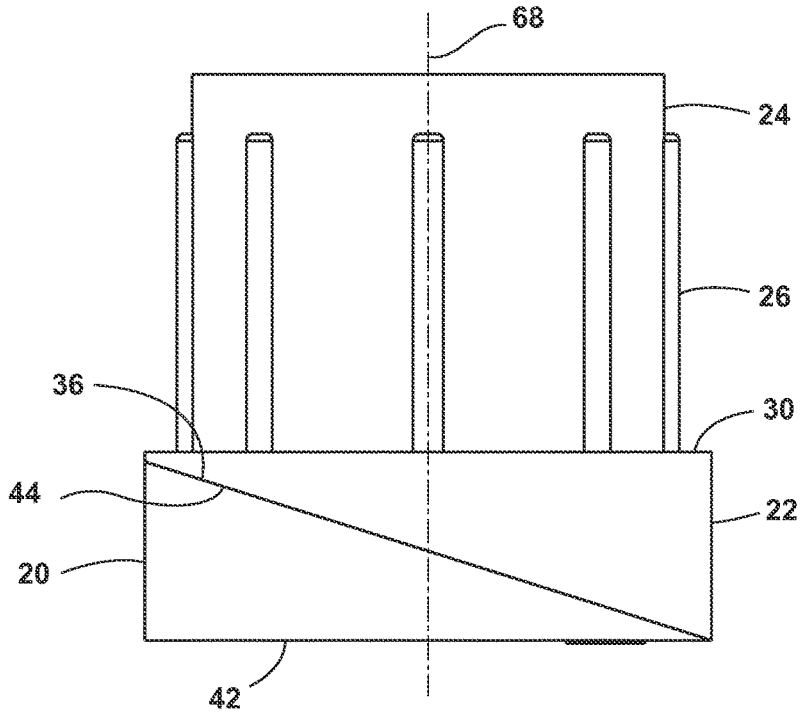
FIG. 6 is a side view of the connector of FIG. 3 according to an embodiment of the invention.
Figure 7:
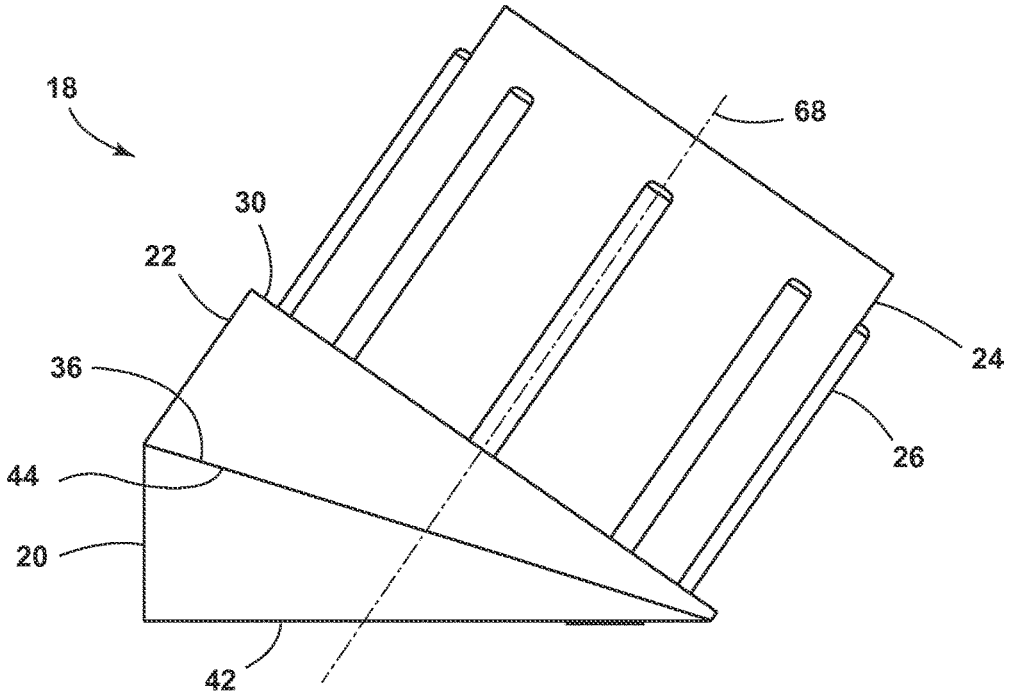
FIG. 7 is a side view of the connector of FIG. 4 according to an embodiment of the invention.

The mating surface 36 of the retaining member 22 can be provided at an angle relative to the baluster mounting face 30. Similarly, the mating surface 44 of the base 20 can be provided at an angle relative to the rail mounting surface 42. As can best be seen in FIGS. 3, 4, 6 and 7, the base 20 can be rotated relative to the retaining member 22 to a first position, illustrated in FIGS. 3 and 6, in which the rail mounting surface 42 is orthogonal to the central axis 68 of the mounting portion 24 of the retaining member 22. The base 20 can also be rotated relative to the retaining member 22 to a second position, illustrated in FIGS. 4 and 7, in which the rail mounting surface 42 is at a predetermined angle with respect to the central axis 68 of the mounting portion 24. The stops 60, 62 on the retaining member 22 and base 20, respectively, can be configured such that a 180 degree rotation of the base 20 relative to the retaining member 22 moves the base 20 between the first and second positions. In this manner, the relative rotation of the base 20 and the retaining member 22 allows the connector 18 to be used to mount the balusters 16 to both a horizontal rail 12, 14 (illustrated in FIG. 1) and an angled rail 12, 14 (illustrated in FIG. 2).

Figure 8:
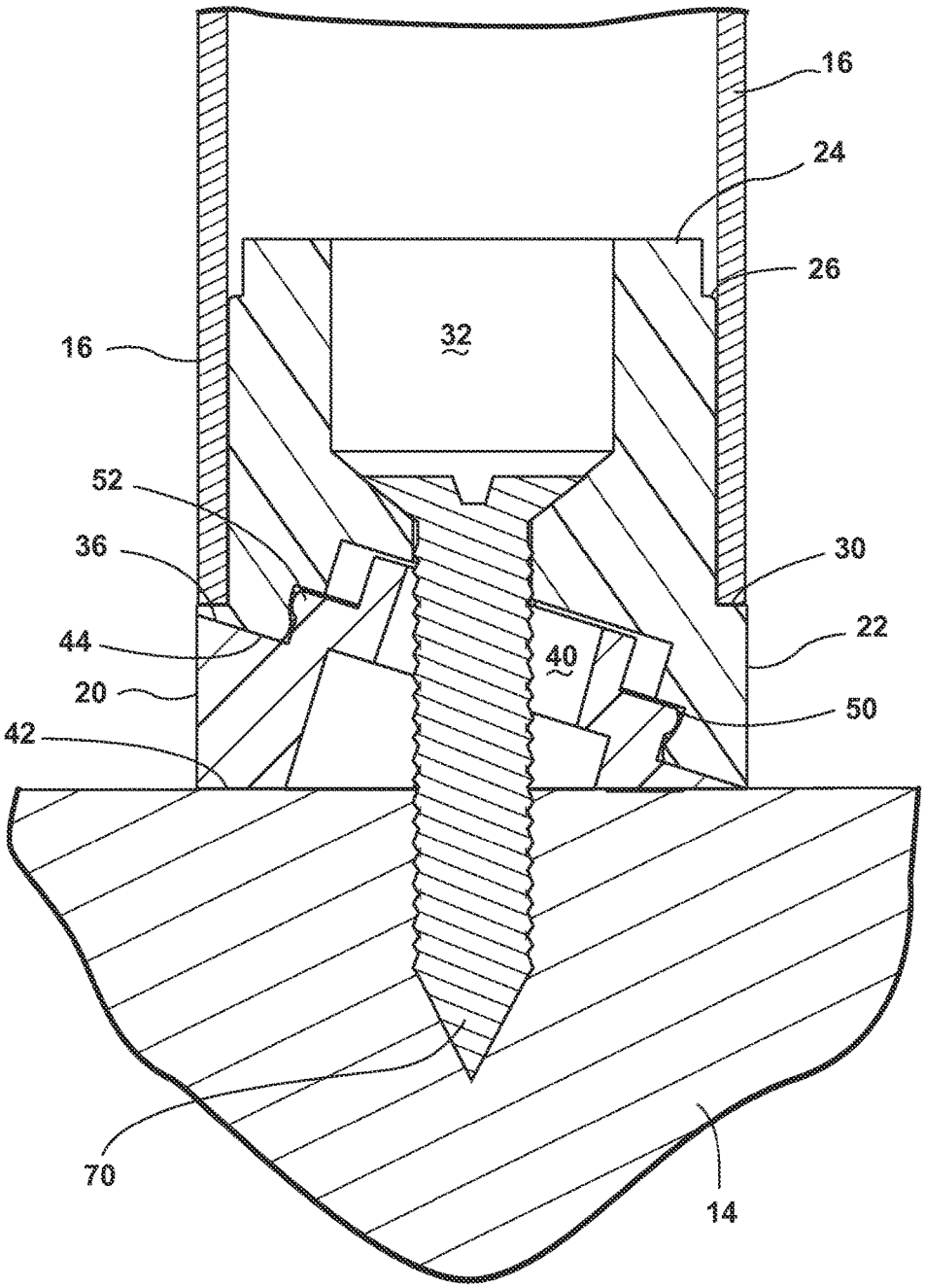
FIG. 8 is sectional view of a connector mounting a baluster to a rail according to an embodiment of the invention.

Referring now to FIG. 8, to mount the baluster 16 to a horizontal lower rail 14, the base 20 can be rotated to the first position such that the rail mounting surface 42 of the base 20 is orthogonal to the central axis 68 of the mounting portion 24. In this position, the rail mounting surface 42 presents a face parallel to a surface of the horizontal rail 14 to which the baluster 16 is to be mounted. In use, the base 20 can be rotated to the first position and a screw 70 inserted through the fastener aperture 32 of the retaining member 22 and the fastener aperture 40 of the base 20 and into the lower rail 14. The baluster 16 can then be slid over the mounting portion 24 and frictionally retained thereon. The connector 18 can be used in a similar manner to mount the balusters 16 to a horizontal upper rail 12. When the baluster 16 is mounted on the connector 18, the retaining member 22 prevents an end of the baluster 16 from directly contacting the rail 14.

Figure 9:
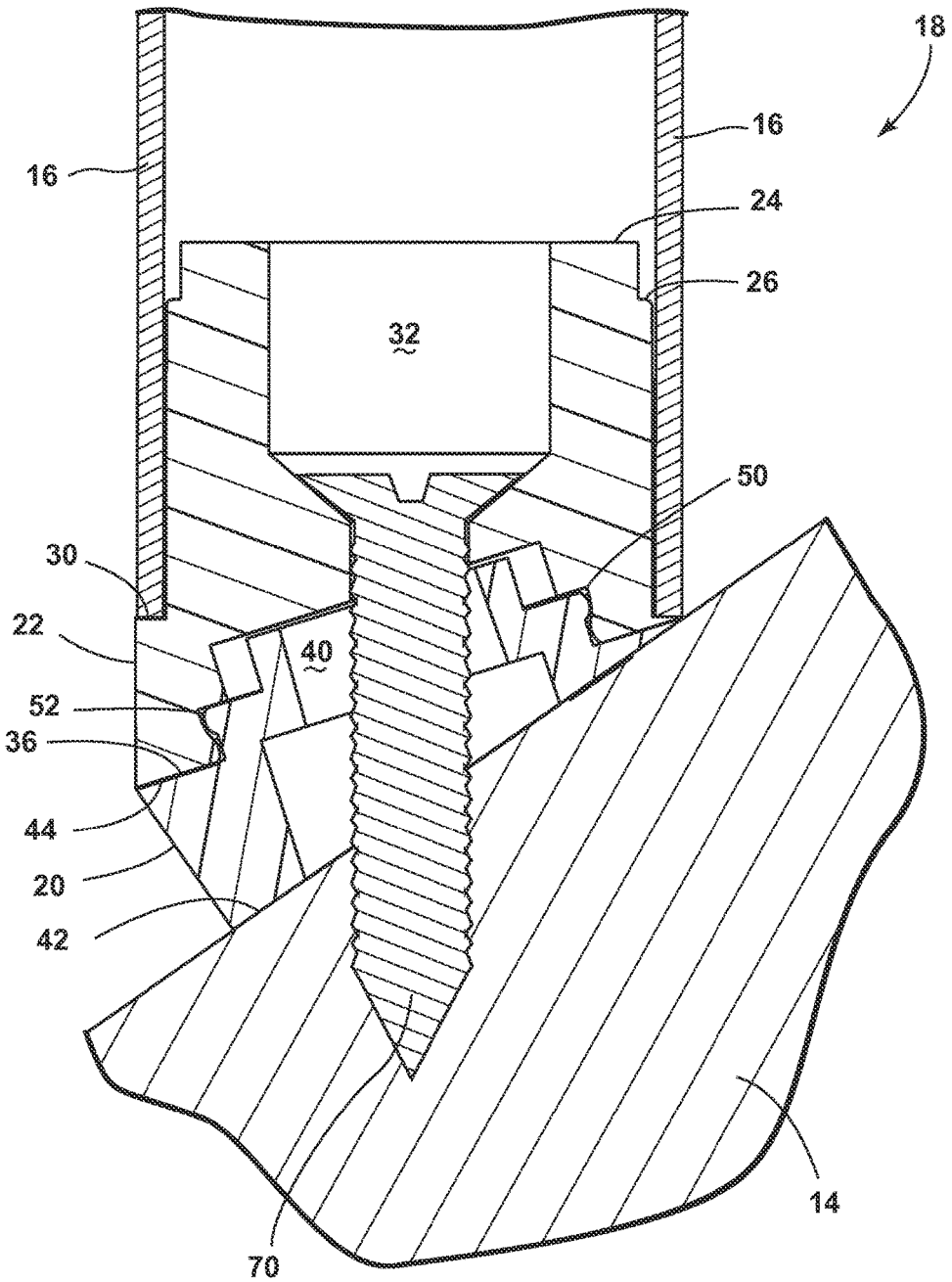
FIG. 9 is sectional view of a connector mounting a baluster to a rail according to an embodiment of the invention.

Referring now to FIG. 9, to mount the baluster 16 to an angled lower rail 14, such as may be used along a stairway, the base 20 can be rotated to the second position such that the rail mounting surface 42 of the base 20 is at a predetermined angle relative to the central axis 68 of the mounting portion 24. In this position, the rail mounting surface 42 can present a face parallel to an angled surface of the rail 14 to which the baluster 16 is to be mounted. As described with respect to FIG. 8, the base 20 can be rotated to the second position and a screw 70 inserted through the fastener aperture 32 of the retaining member 22 and the fastener aperture 40 of the base 20 and into the lower rail 14. The baluster 16 can then be slid over the mounting portion 24 and frictionally retained thereon. The connector 18 can be used in a similar manner to mount the baluster 16 to an angled upper rail 12.

The angle of the mating surfaces 36 and 44 of the retaining member 22 and base 20, respectively, can be configured to provide a desired angle of the baluster 16 based on the angle of the rail 12, 14 to which the baluster 16 is to be mounted. For example, stairways are typically constructed at a predetermined angle relative to the horizontal surface from which they extend (i.e. the floor). However, typically, it is still desired that the balusters be constructed orthogonal to the horizontal surface. The mating surfaces 36, 44 can be provided at a predetermined angle, such as half of the angle of the stairway with which the balusters 16 are to be installed. In the example of a typical stairway constructed at a 35 degree angle relative to horizontal, the mating surfaces 36, 44 can be provided at 17.5 degrees relative to the baluster and rail mounting surfaces 30, 42. In this manner, when the base 20 is rotated to the second position and the connector 18 is used to mount the balusters 16 to a rail 12, 14 constructed at a 35 degree angle, the balusters 16 will extend straight between the rails 12, 14, i.e. orthogonal to the horizontal surface the stairway is constructed on.

FIGS. 10-14 illustrate another embodiment of the invention comprising a connector 118 that is similar to the connector 18 except for the shape of the connector 118. Therefore, elements in the connector 118 similar to those of connector 18 will be numbered with the prefix 100.

Figure 10:
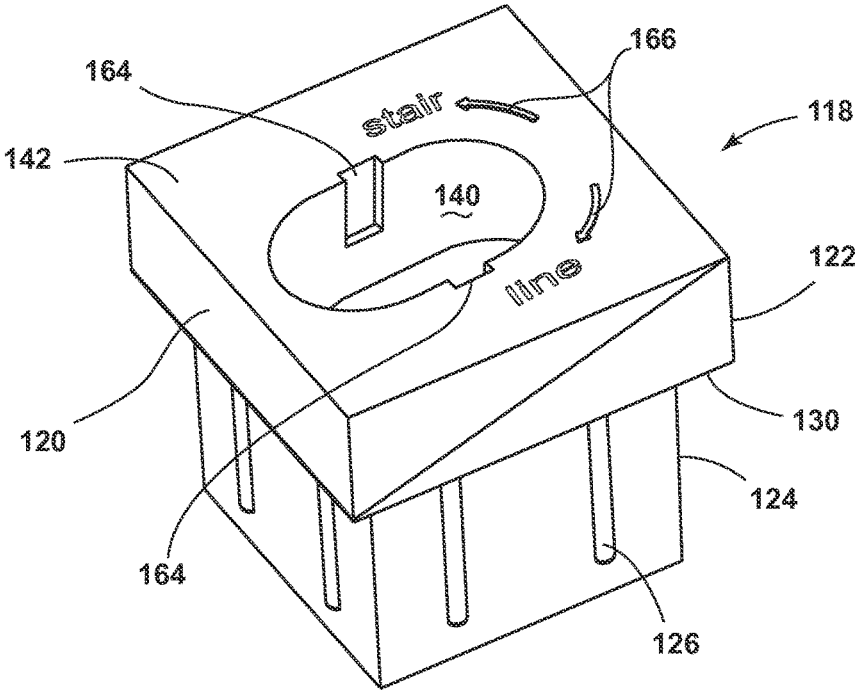
FIG. 10 is an isometric view of a connector for use with a railing assembly according to an embodiment of the invention.
Figure 11:
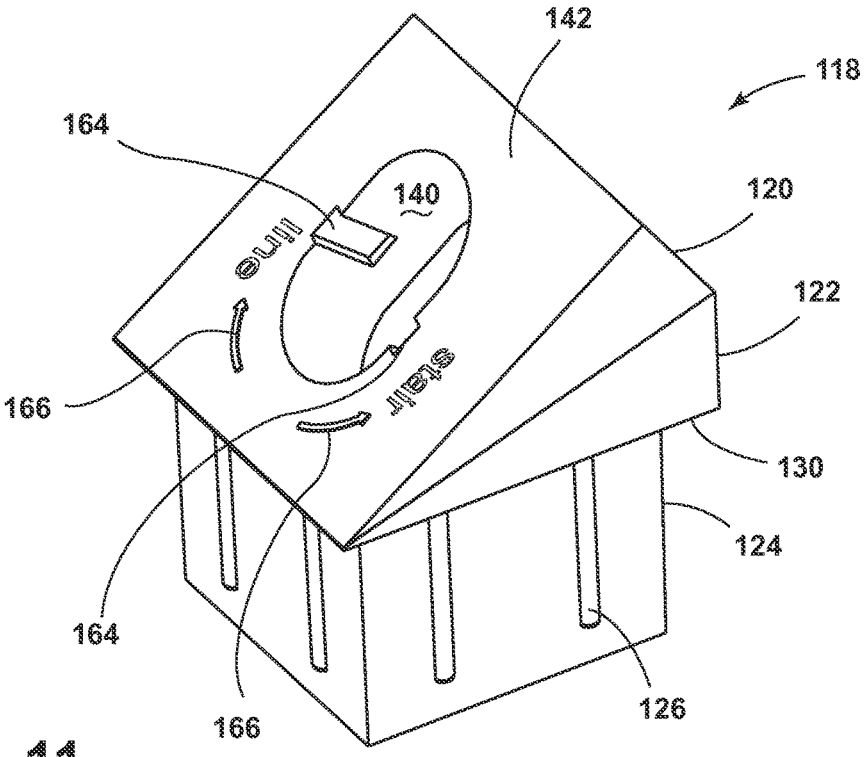
FIG. 11 is an isometric view of a connector for use with a railing assembly according to an embodiment of the invention.
Figure 12:
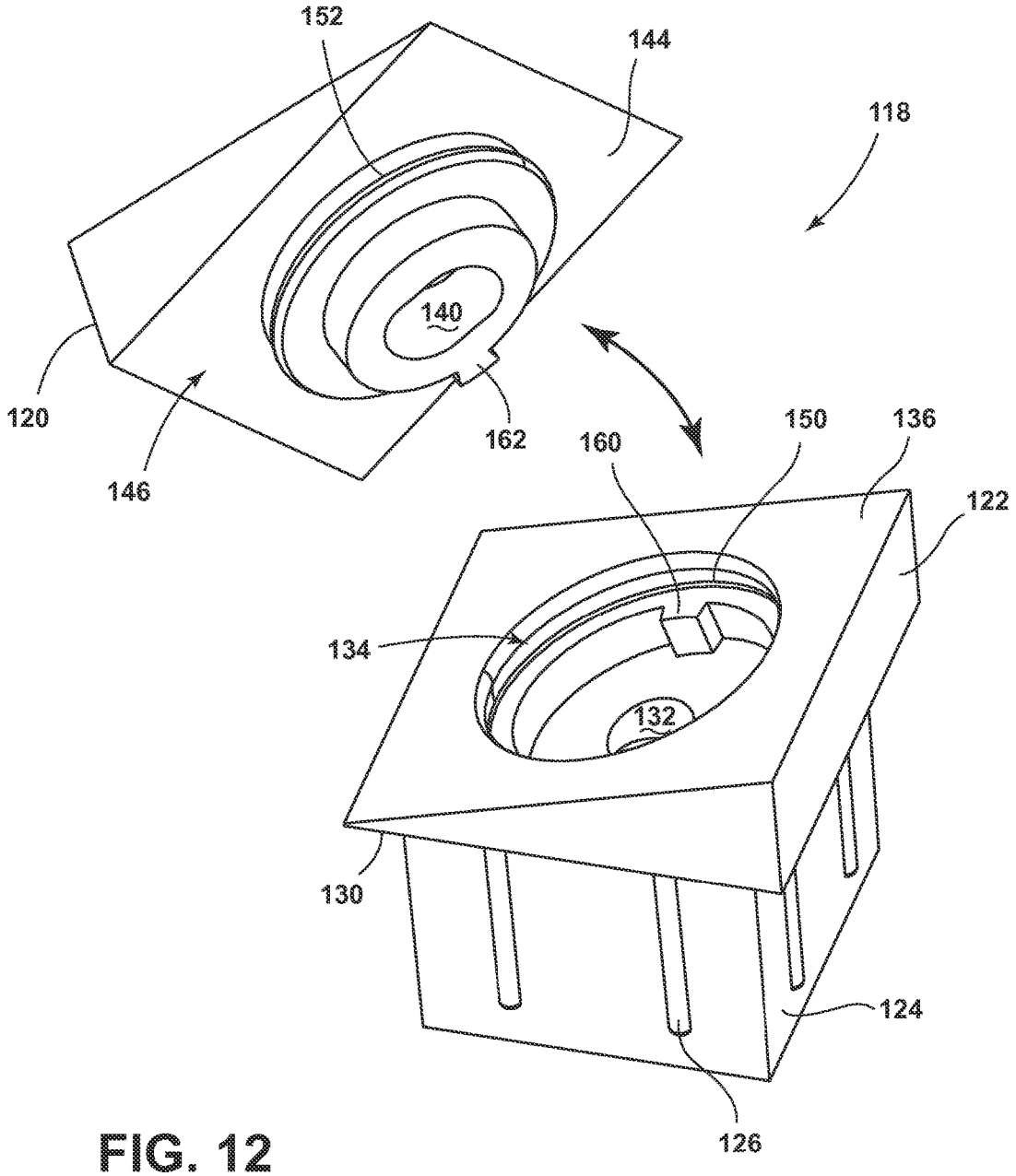
FIG. 12 is an exploded view of the connector of FIGS. 10 and 11 according to an embodiment of the invention.

As can best be seen in FIGS. 10-12, the connector 118 has a generally polygonal shape compared to the circular shape of the connector 18. The connector 18 is configured to be used with balusters having a circular cross-section, whereas the connector 118 is configured for use with balusters having a polygonal cross-section. As illustrated in FIGS. 10-12, the mounting portion 124 can have a generally square cross-section for mounting a baluster having a corresponding square cross-section (not shown). It is also within the scope of the invention for the mounting portion 124 to have any suitable polygonal cross-section to mount a baluster having a corresponding polygonal cross-section, non-limiting examples of which include a triangular, rectangular, hexagonal, diamond, or octagonal cross-section. In addition, while the connector 18 is illustrated for use with a baluster 16 having a circular cross-section, it is within the scope of the invention for the connector 18 to have a mounting portion 24 configured for mounting a baluster having an oval cross-section.

Still referring to FIGS. 10-12, the base 120 and retaining member 122 also have a polygonal cross-section. The size and shape of the base 120 and retaining member 122 are generally configured to correspond to the dimensions of the baluster such that when assembled, exterior edges of the baluster are flush with the exterior edges of the connector 118, in a manner similar to that shown in FIGS. 8 and 9 for the connector 18 and baluster 16. However, it will be understood that the relative dimensions of the connector 18, 118 and baluster 16 can be configured to highlight or expose more or less of the connector 18, 118 when assembled with the baluster 16. For example, the base 20, 120 and/or retaining member 22, 122 can be provided with a decorative shape or accent to provide a desired aesthetic to the assembly.

Figure 13:
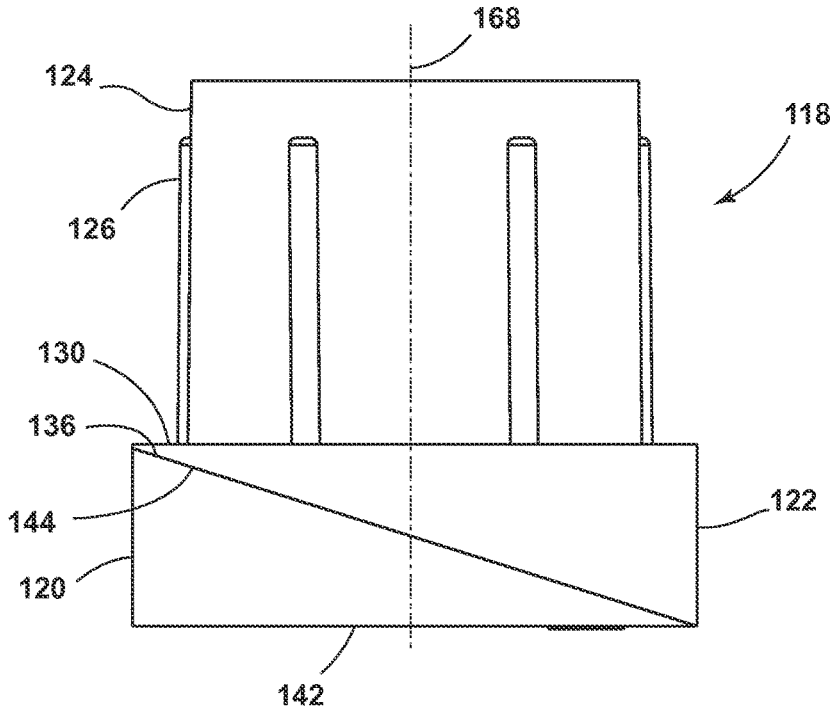
FIG. 13 is a side view of the connector of FIG. 10 according to an embodiment of the invention.
Figure 14:
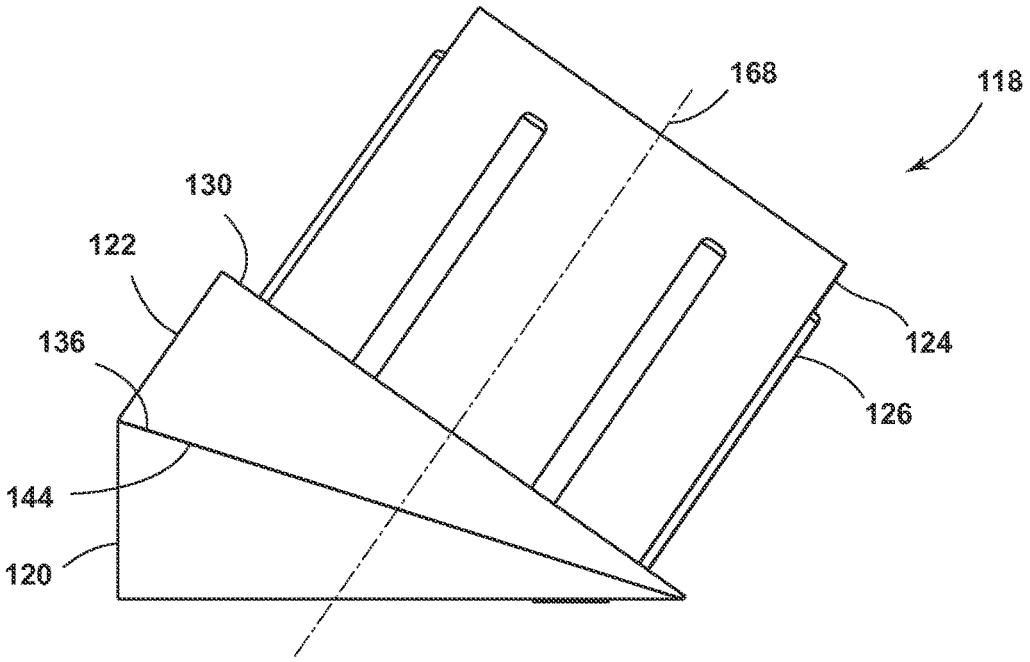
FIG. 14 is a side view of the connector of FIG. 11 according to an embodiment of the invention.

Referring now to FIGS. 13 and 14, the base 120 and retaining member 122 can be rotated relative to each other for use in mounting balusters to both a horizontal and angled rail in the same manner as described above for the connector 18 with respect to FIGS. 6-9.

Figure 15:
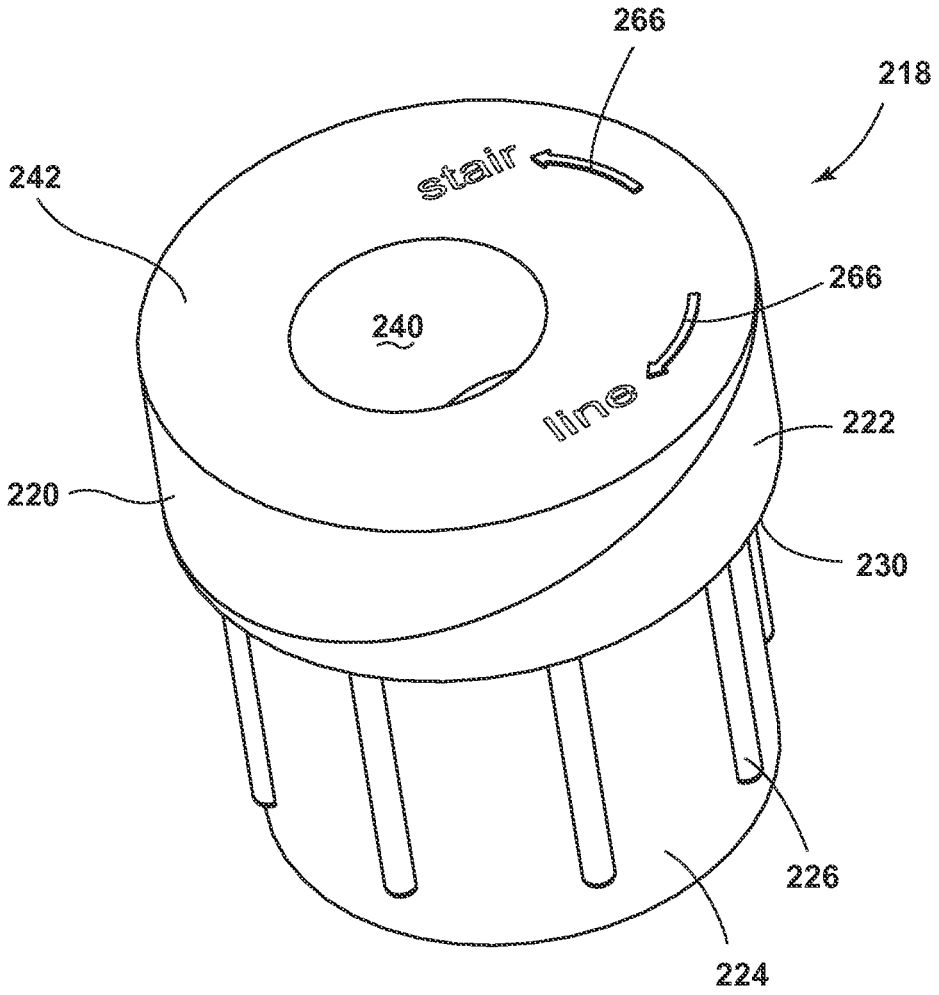
FIG. 15 is an isometric view of a connector for use with a railing assembly according to an embodiment of the invention.

FIG. 15 illustrates another embodiment of the invention comprising a connector 218 that is similar to the connector 18 except for the shape of the fastener aperture. Therefore, elements in the connector 218 similar to those of connector 18 will be numbered with the prefix 200. The connector 218 includes a fastener aperture 240 which is similar to the fastener aperture 40 of the connector 18 of FIGS. 3-4, except for that the fastener aperture 240 is circular instead of oval. The oval fastener apertures 40 and 140 of the connectors 18 and 118, respectively, provide space for inclusion of the optional screw driver grooves 64 and 164 which can be used to facilitate rotation of the base 20, 120 relative to the retaining member 22, 122. In addition, the oval aperture 40, 140 can provide more room for the fastener to be inserted during assembly and then further prevent relative rotation of the base 20 with the fastener inserted therein.

While the connector 18 is illustrated as being visible on a surface of the rail 12, 14 in FIGS. 1-2 and 8-9, it is within the scope of the invention for any of the connectors 18, 118, 218 described herein to be countersunk within an aperture provide in the rail 12, 14 such that the baluster mounting face 30, 130, 230 is flush or positioned below the surface of the rail so that no portion of the connector 18, 118, 218 is visible when assembled with a baluster 16 and so that an end of the baluster 16 is generally flush with the surface of the rail 12, 14 or received within the aperture in the rail 12, 14.

In addition, while the connectors 18, 118, 218 are described in the context of mounting balusters 16 to both upper and lower rails 12, 14, it will be understood that only a single connector 18, 118, 218 can be used to mount the baluster 16 to only one of the upper or lower rails 12, 14. It is also within the scope of the invention for the connectors 18, 118, 218 to be used to mount the baluster 16 at one or both ends to a surface other than rail, such as a floor.

The embodiments of the invention described herein provide a baluster connector for use in assembling balusters and railings that can be used for both horizontal and angled railing assemblies. Typically, separate connectors are provided for horizontal and angled railing assemblies or, if a single connector is used, the installer is required to cut the end of the baluster at an angle in order to assemble straight, vertical balusters between the angled rails. Providing separate connectors for horizontal and angled assemblies can be confusing to the consumer, increase production and shipping costs and increase retailer cost, as the separate connectors require more shelf space for display and one type of connector may sell faster than the other. Requiring the baluster to be cut on angle for installation on sloped surfaces, such as stairways, is time consuming for the installer, and, if mistakes are made during cutting, can increase costs.

The inventive connectors 18, 118, 218 described herein provide a single connector which can be simply rotated for use in either horizontal railing assemblies or angled railing assemblies. A single connector for use in both installation conditions saves production, shipping and storage costs and also provides convenience to consumers and retailers. In addition, the connector can be used to mount balusters to angled rails without the need to cut the baluster end on an angle, further increasing the ease of use for the consumer and installer. In addition, inventive connectors 18, 118, 218 described herein support the ends of the balusters on the baluster mounting face 30, 130, 230, which can prevent the ends of the balusters from coming into direct contact with the rails. This can be important depending on the materials used to make the balusters and the rails. For example, it is typically not recommended that aluminum balusters directly contact certain types of treated wood, as some of the materials used to treat the wood may interact with the metal baluster in an undesirable manner.

To the extent not already described, the different features and structures of the various embodiments of the invention may be used in combination with each other as desired. For example, one or more of the features illustrated and/or described with respect to one of the connectors 18, 118, 218 can be used with or combined with one or more features illustrated and/or described with respect to the other of the 18, 118, 218. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A connector for a railing system having a plurality of balusters disposed between an upper rail and a lower rail, the connector connecting a baluster to one of the upper and lower rails, the connector comprising:

a base having a periphery and a central opening therein extending between a first surface and a second surface in an opposed relationship with the first surface, wherein the first and second surfaces are positioned at an inclined angle with respect to one another; and a retaining member having a mounting portion defining a central axis and configured to mount an end of a baluster at one end along the central axis, and an interengaging member at an opposite end configured to be rotatably mounted to the base in juxtaposition with respect to the second surface of the base, wherein the retaining member has a central aperture extending along the central axis between the mounting portion and the interengaging member at the opposite end thereof;

wherein the second surface and the interengaging member comprise planar inclined surfaces which rotate relative to each other about the central axis between a horizontal position and an inclined position;

wherein in the horizontal position, the interengaging member and the base form an axial relationship corresponding to an angle for the upper and lower rails in a horizontal orientation, and in the inclined position, the interengaging member and the base form an inclined relationship corresponding to an angle for the upper and lower rails on a inclined staircase;

wherein, in both the horizontal position and the inclined position, the central axis extends through the central opening at the first and second surfaces of the base; and wherein in either the horizontal or the inclined relationship, the central opening and central aperture are aligned to receive a fastener, with the fastener extending along the central axis to allow the fastener to be passed through the central opening in the base and the central aperture in the retaining member to mount the base and the retaining member to the upper or lower rail;

wherein in the inclined position, the interengaging member and the base form an inclined relationship corresponding to an angle of 35 degrees for the upper and lower rails on a inclined staircase.

2. The connector of claim 1 and further comprising a threaded fastener for mounting the base to the upper or lower rail, wherein the fastener extends through the central opening and central aperture along the central axis in both the horizontal position and the inclined position.

3. The connector of claim 1 wherein the central aperture in the retaining member comprises a tapered screw seat at the end of the central aperture corresponding to the interengaging member, wherein the tapered screw seat tapers toward the end of the central aperture corresponding to the interengaging member.

4. A connector for a railing system having a plurality of balusters disposed between an upper rail and a lower rail, the connector connecting a baluster to one of the upper and lower rails, the connector comprising:

a base having a periphery and a central opening therein extending between a first surface and a second surface in an opposed relationship with the first surface, wherein the first and second surfaces are positioned at an inclined angle with respect to one another; and a retaining member having a mounting portion defining a central axis and configured to mount an end of a baluster at one end along the central axis, and an interengaging member at an opposite end configured to be rotatably mounted to the base in juxtaposition with respect to the second surface of the base, wherein the retaining member has a central aperture extending along the central axis between the mounting portion and the interengaging member at the opposite end thereof;

wherein the second surface and the interengaging member comprise planar inclined surfaces which rotate relative to each other about the central axis between a horizontal position and an inclined position;

wherein in the horizontal position, the interengaging member and the base form an axial relationship corresponding to an angle for the upper and lower rails in a horizontal orientation, and in the inclined position, the interengaging member and the base form an inclined relationship corresponding to an angle for the upper and lower rails on a inclined staircase;

wherein, in both the horizontal position and the inclined position, the central axis extends through the central opening at the first and second surfaces of the base; and wherein in either the horizontal or the inclined relationship, the central opening and central aperture are aligned to receive a screw, with the screw extending along the central axis to allow the screw to be passed through the central opening in the base and the central aperture in the retaining member to mount the base and the retaining member to the upper or lower rail;

wherein the central aperture of the retaining member comprises a tapered screw seat at the end of the central aperture corresponding to the interengaging member, wherein the tapered screw seat tapers toward the base and is configured to engage a tapered head of the screw extending along the central axis and through the base.

5. The connector of claim 4 wherein the mounting portion of the retaining member has a circular or elliptical periphery adapted to receive a circular or elliptical baluster.

6. The connector of claim 4 wherein the mounting portion of the retaining member has a square or rectangular periphery adapted to receive a square or rectangular baluster.

7. The connector of claim 4 wherein the mounting portion of the retaining member has a plurality of ribs extending axially along the periphery thereof.

8. The connector of claim 4 wherein the central opening of the base has a pair of grooves disposed opposite of one another, providing an insertion point for a tool to rotate the base with respect to the retaining member.

9. The connector of claim 4 wherein the base has indicia indicating a direction of rotation to move the base with respect to the retaining member to position the retaining member in the horizontal or the inclined position.

10. The connector of claim 4 wherein the base has one of a detent and a groove with the central opening, and the retaining member mounting portion has the other of a detent and a groove for rotatably mounting the base to the retaining member.

11. The connector of claim 10 wherein at least one of the base and the retaining member mounting portion has a stop located thereon to define an end of a range of movement between the horizontal position and the inclined position.

12. The connector of claim 4 wherein the base has a threaded portion, and the interengaging member has a mating threaded portion for rotatably mounting the base to the retaining member.

13. The connector of claim 12 wherein at least one of the base and the interengaging member has a stop located thereon to define an end of a range of movement between the horizontal position and the inclined position.

14. The connector of claim 4 wherein the inclined surfaces of the base and the retaining member are each inclined with respect to horizontal by one-half of the incline of a staircase with respect to horizontal.

15. The connector of claim 14 wherein the inclined surfaces of the base and the retaining member are each inclined 17.5° with respect to horizontal.

16. The connector of claim 4 wherein the central aperture in the retaining member is smaller than the central opening in the base in a radial direction.

17. The connector of claim 16 wherein the central aperture in the retaining member is circular and the central opening in the base has an elongated rounded shape.

18. The connector of claim 4 wherein the central aperture comprises a first end at the mounting portion and a second end at the interengaging member, wherein the first end is wider than the second end, and wherein the tapered screw seat joins the first end with the second end and tapers toward the second end.

19. The connector of claim 4, wherein the retaining member comprises a baluster mounting face configured to abut the end of the baluster, wherein the mounting portion extends from the baluster mounting face and wherein the baluster mounting face is spaced from the planar inclined surface of the interengaging member and the base such that the baluster does not contact the upper or lower rail.

20. A kit comprising:

only a single fastener; and a connector for a railing system having a plurality of balusters disposed between an upper rail and a lower rail, the connector connecting a baluster to one of the upper and lower rails, the connector comprising:

a base having a periphery and a central opening therein extending between a first surface and a second surface in an opposed relationship with the first surface, wherein the first and second surfaces are positioned at an inclined angle with respect to one another; and a retaining member having a mounting portion defining a central axis and configured to mount an end of a baluster at one end along the central axis, and an interengaging member at an opposite end configured to be rotatably mounted to the base in juxtaposition with respect to the second surface of the base, wherein the retaining member has a central aperture extending along the central axis between the mounting portion and the interengaging member at the opposite end thereof;

wherein the second surface and the interengaging member comprise planar inclined surfaces which rotate relative to each other about the central axis between a horizontal position and an inclined position;

wherein in the horizontal position, the interengaging member and the base form an axial relationship corresponding to an angle for the upper and lower rails in a horizontal orientation, and in the inclined position, the interengaging member and the base form an inclined relationship corresponding to an angle for the upper and lower rails on a inclined staircase;

wherein, in both the horizontal position and the inclined position, the central axis extends through the central opening at the first and second surfaces of the base; and wherein in either the horizontal or the inclined relationship, the central opening and central aperture are aligned to receive the single fastener, with the single fastener extending along the central axis and passing through the central opening in the base and the central aperture in the retaining member to mount the base and the retaining member to the upper or lower rail.

21. The kit of claim 20 wherein the central aperture in the retaining member comprises a tapered screw seat at the end of the central aperture corresponding to the interengaging member and the single fastener comprises a screw with a tapered head configured to engages the tapered screw seat.

* * * * *